US008591208B2

(12) United States Patent
Broerman, III et al.

(10) Patent No.: US 8,591,208 B2
(45) Date of Patent: Nov. 26, 2013

(54) MULTI-FREQUENCY PULSATION ABSORBER AT CYLINDER VALVE CAP

(75) Inventors: Eugene L. Broerman, III, San Antonio, TX (US); Danny M. Deffenbaugh, San Antonio, TX (US); Robert J. McKee, Everett, WA (US)

(73) Assignee: Southwest Research Institute, San Antonio, TX (US)

( * ) Notice: Subject to any disclaimer, the term of this patent is extended or adjusted under 35 U.S.C. 154(b) by 454 days.

(21) Appl. No.: 12/490,879

(22) Filed: Jun. 24, 2009

(65) Prior Publication Data

US 2010/0329899 A1 Dec. 30, 2010

(51) Int. Cl.
*F04B 11/00* (2006.01)

(52) U.S. Cl.
USPC ..... 417/540; 181/403

(58) Field of Classification Search
USPC ..... 417/53, 312, 540, 542; 181/250, 272, 181/403, 259, 262, 263
See application file for complete search history.

(56) References Cited

U.S. PATENT DOCUMENTS

| | | | | |
|---|---|---|---|---|
| 2,271,055 | A | 1/1942 | Wilson | 181/48 |
| 2,405,100 | A * | 7/1946 | Stephens | 137/565.18 |
| 2,437,446 | A * | 3/1948 | Stephens | 181/276 |
| 2,501,794 | A * | 3/1950 | Stephens | 138/26 |
| 2,841,236 | A * | 7/1958 | Moerke | 181/238 |
| 2,936,041 | A * | 5/1960 | Sharp et al. | 181/206 |
| 2,951,638 | A | 9/1960 | Hughes et al. | |
| 2,973,132 | A | 2/1961 | Hirsch | |
| 2,993,559 | A * | 7/1961 | Everett | 181/268 |
| 3,807,527 | A * | 4/1974 | Bergson et al. | 181/232 |
| 3,940,721 | A * | 2/1976 | Kojima et al. | 333/233 |
| 4,330,239 | A * | 5/1982 | Gannaway | 417/312 |
| 4,445,829 | A * | 5/1984 | Miller | 417/543 |
| 4,514,151 | A * | 4/1985 | Anders et al. | 417/540 |
| 4,734,011 | A * | 3/1988 | Hall, Jr. | 417/2 |
| 4,779,415 | A * | 10/1988 | Richardson et al. | 60/313 |
| 4,905,790 | A * | 3/1990 | Luszczycki | 181/272 |
| 5,139,392 | A * | 8/1992 | Pettitt et al. | 417/269 |
| 5,208,429 | A * | 5/1993 | Field | 181/229 |
| 5,288,212 | A * | 2/1994 | Lee | 417/312 |
| 5,307,782 | A * | 5/1994 | Davis | 123/510 |
| 5,312,235 | A * | 5/1994 | McHugh | 418/181 |
| 5,457,290 | A * | 10/1995 | Sase et al. | 181/258 |
| 5,583,325 | A * | 12/1996 | Schutte et al. | 181/237 |
| 5,739,483 | A * | 4/1998 | Yashiro et al. | 181/254 |
| 5,930,371 | A * | 7/1999 | Cheng et al. | 381/71.5 |
| 5,996,733 | A | 12/1999 | DeTuncq et al. | 181/250 |
| 6,012,908 | A | 1/2000 | Tanaka | |
| 6,152,703 | A | 11/2000 | Yoshimura et al. | |
| 6,173,808 | B1 * | 1/2001 | Maeda et al. | 181/254 |
| 6,260,659 | B1 * | 7/2001 | Takahashi et al. | 181/255 |

(Continued)

FOREIGN PATENT DOCUMENTS

| | | |
|---|---|---|
| WO | WO2006030559 | 3/2006 |

*Primary Examiner* — Devon Kramer
*Assistant Examiner* — Amene Bayou
(74) *Attorney, Agent, or Firm* — Chowdhury & Georgakis P.C.; Ann C. Livingston

(57) ABSTRACT

A multi-chambered pulsation absorber for attachment over the valve cap opening of a compressor cylinder. Each chamber is in fluid communication with the valve cap opening (or cylinder internal gas passages) via an associated choke tube. Each pairing of a chamber with a choke tube is tuned, in the manner of a Helmholz resonator, to attenuate and nearly eliminate a different cylinder-related pulsation frequency, such as those resulting from internal cylinder pulsations or cylinder nozzle pulsations.

8 Claims, 3 Drawing Sheets

(56) References Cited

U.S. PATENT DOCUMENTS

| | | | | |
|---|---|---|---|---|
| 6,295,363 | B1 | 9/2001 | Laak | |
| 6,390,132 | B1 * | 5/2002 | Johnson et al. | 138/30 |
| 6,415,888 | B2 * | 7/2002 | An et al. | 181/281 |
| 6,427,802 | B1 * | 8/2002 | Yokoi et al. | 181/282 |
| 6,453,695 | B1 | 9/2002 | Marks et al. | 62/323.1 |
| 6,533,064 | B1 | 3/2003 | Kim | |
| 6,684,842 | B1 | 2/2004 | Hellie et al. | 123/184.57 |
| 6,814,041 | B1 | 11/2004 | Cheng | |
| 7,246,680 | B2 | 7/2007 | Osterkamp | |
| 7,866,147 | B2 | 1/2011 | Harris | |
| 2002/0148679 | A1 * | 10/2002 | Grandmougin et al. | 181/272 |
| 2003/0136119 | A1 | 7/2003 | Marks | |
| 2004/0065303 | A1 | 4/2004 | Russell | |
| 2004/0065504 | A1 * | 4/2004 | Daniels | 181/252 |
| 2004/0247457 | A1 * | 12/2004 | Kim et al. | 417/312 |
| 2005/0126850 | A1 * | 6/2005 | Yamaguchi et al. | 181/249 |
| 2005/0252716 | A1 * | 11/2005 | Moenssen et al. | 181/277 |
| 2006/0027204 | A1 * | 2/2006 | Vogt et al. | 123/184.57 |
| 2006/0171819 | A1 * | 8/2006 | Fox et al. | 417/312 |
| 2006/0243520 | A1 * | 11/2006 | Hertenstein et al. | 181/229 |
| 2007/0130926 | A1 | 6/2007 | Jett | |
| 2007/0289653 | A1 | 12/2007 | Harris | |
| 2008/0253900 | A1 | 10/2008 | Harris | |

* cited by examiner

MULTI-FREQUENCY PULSATION ABSORBER AT CYLINDER VALVE CAP

TECHNICAL FIELD OF THE INVENTION

This invention relates to reciprocating compressors for transporting natural gas or other gases, and more particularly to a method for reducing pulsations in the compressor system associated with such compressors.

BACKGROUND OF THE INVENTION

To transport natural gas from production sites to consumers, pipeline operators install large compressors at transport stations along the pipelines. Natural gas pipeline networks connect production operations with local distribution companies through thousands of miles of gas transmission lines. Typically, reciprocating gas compressors are used as the prime mover for pipeline transport operations because of the relatively high pressure ratio required. Reciprocating gas compressors may also be used to compress gas for storage applications or in processing plant applications prior to transport.

Reciprocating gas compressors are a type of compressor that compresses gas using a piston in a cylinder connected to a crankshaft. The crankshaft may be driven by a motor or an engine. A suction valve in the compressor cylinder receives input gas, which is then compressed by the piston and discharged through a discharge valve.

Reciprocating gas compressors inherently generate transient pulsating flows because of the piston motion and alternating valve motion. Various devices and control methods have been developed to control these pulsations. An ideal pulsation control design reduces system pulsations to acceptable levels without compromising compressor performance.

A specific challenge when using high-horsepower, high-speed, variable-speed compressors is pulsations in the cylinder nozzle. The cylinder nozzle is the section of pipe that connects the cylinder to the suction or discharge side of the compressor, typically to a filter bottle. This section of pipe can provide significant resonance responses. Currently, one solution to attenuating cylinder nozzle pulsations is the installation of an orifice in the cylinder nozzle. For example, a plate with a flow restricting hole may be placed across the circumference of the nozzle. However, a drawback to use of the orifice is that it causes a pressure drop that requires the supply of additional horsepower. This burden can be significant on large horsepower units.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a multi-chamber pulsation absorber for reducing pulsations of a compressor system. The absorber, mounted at a cylinder valve cap and having properly designed acoustic dimensions, is capable of altering the acoustically resonant frequencies of the cylinder internals as well as of the cylinder nozzle. The absorber eliminates the need for a nozzle orifice and reduces the cylinder internal pulsations such that associated vibrations, valve life problems, and/or efficiency problems associated with those pulsations are nearly eliminated.

As stated in the Background, pulsation absorbers may be attached to the cylinder nozzle. However, these absorbers address only the cylinder nozzle response frequency. Other resonances associated with the cylinder internal gas passages are not addressed with the single volume and choke.

Figure 1:
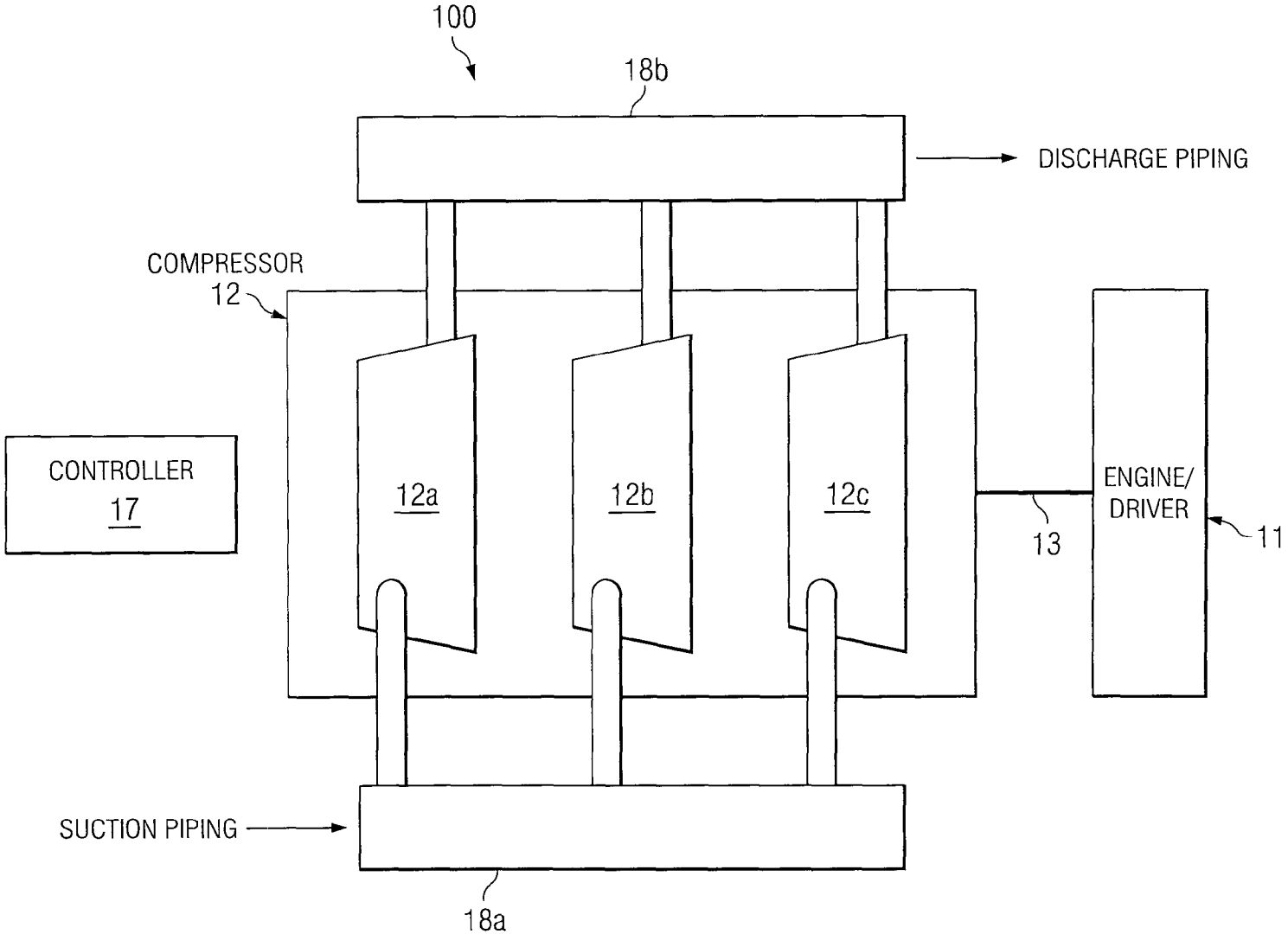
FIG. 1 is a block diagram of a reciprocating gas compressor system.

FIG. 1 is a block diagram of the basic elements of a reciprocating gas compressor system 100. The elements of compressor system 100 are depicted as those of a typical or "generic" system, and include a driver 11, compressor 12, suction filter bottle 18*a*, discharge filter bottle 18*b*, suction and discharge piping connections, and a controller 17.

In the example of FIG. 1, compressor 12 has three compressor cylinders 12*a*-12*c*. In practice, compressor 12 may have fewer or more (often as many as six) cylinders. Further, it may have either an integral or separate engine or motor driver 11. The output of driver 11 (motor or engine) may be variable speed and power, unloaded through the compressor. The driver 11 is often an internal combustion engine.

The following description is written in terms of the "generic" compressor system 100. However, the same concepts are applicable to other compressor configurations.

A typical application of compressor system 100 is in the gas transmission industry. The compressor station operates between two gas transmission lines. The first line, at an initial pressure, is referred to as the suction line. The second line, at the exit pressure for the station, is referred to as the discharge line. The suction and discharge lines are also referred to in the industry as the "lateral piping". The pressure ratio (discharge pressure divided by suction pressure) may vary between 1.15 to 4.0 or more, depending on the pipeline operation requirements and the application.

Filter bottles 18*a* and 18*b* are placed between the compressor and the lateral piping, on the suction or discharge side or on both sides. Filter bottles such as these are installed as a common method for pulsation control. They operate with surge volumes, and are commonly implemented as volume-choke-volume devices. They function as low-pass acoustic filters, and attenuate pulsations on the basis of a predetermined Helmholtz response.

Controller 17 is used for control of parameters affecting compressor load and capacity. The pipeline operation will vary based on the flow rate demands and pressure variations. The compressor must be capable of changing its flow capacity and load according to the pipeline operation. Controller 17 is equipped with processing and memory devices, appropriate input and output devices, and an appropriate user interface. It is programmed to perform the various control tasks and deliver control parameters to the compressor system. Given appropriate input data, output specifications, and control objectives, algorithms for programming controller 17 may be developed and executed.

Figure 2:
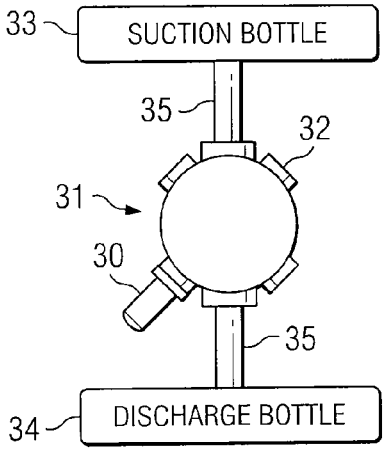
FIG. 2 illustrates a multi-chamber pulsation absorber installed at a cylinder valve cap in accordance with the invention.

FIG. 2 illustrates a nozzle pulsation absorber 30 installed at a cylinder valve cap 32 in accordance with the invention. Although only one cylinder 31 and one absorber 30 are shown, additional absorbers 30 may be installed on more than one cylinder, and they may be installed on the suction side and/or the discharge side of the cylinder(s). The cylinder nozzle 35 is a section of pipe that connects the cylinder 31 to the discharge or suction side of the compressor.

Compressor valves (not explicitly visible in FIG. 2) are installed on each cylinder 31 to permit one-way flow into or out of the cylinder volume. In the example of FIG. 2, cylinder 31 is illustrated as having two suction valves and two discharge valves, with valve caps 32 on three valves and an absorber 30 at one of the discharge valves.

As explained below, nozzle pulsation absorber 30 is a multi-chamber side branch absorber, having multiple choke tubes and volumes. In accordance with the invention, absorber 30 can be designed to dampen multiple pulsation frequencies, including (but not limited to) the cylinder internal (valve-to-valve) response, the response of the cylinder nozzle, and the cylinder internal cross-mode.

Figure 3:
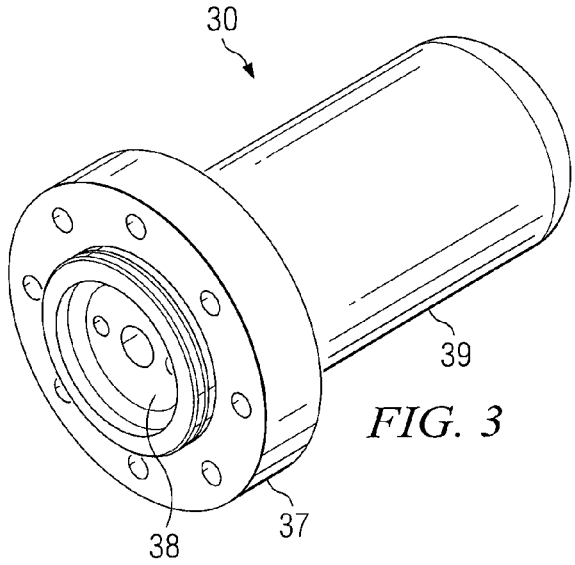
FIG. 3 is a perspective view of the multi-chamber pulsation absorber.

FIG. 3 is a perspective view of the absorber 30. Its housing 39 provides the outer shell for two or more internal chambers, as explained below in connection with FIG. 4. The housing is typically cylindrical in shape, but other geometries are possible. The longitudinal axis of housing 39 extends vertically from the compressor valve opening.

A flange 37 is a large ring at one end of housing 39, and facilitates attachment of the absorber 30 to the valve cap opening. The absorber may be integrated with the cylinder valve cap, so that the valve cap and absorber are a single assembly. In some cases it may be necessary to attach the absorber to a modified valve cap. Therefore, the absorber is installed in place of or attached to a valve cap. The attachment of the absorber on the compressor cylinder is a sealed attachment, with the cylinder's internal gas passage open only to the absorber's internal choke tubes.

Figure 4:
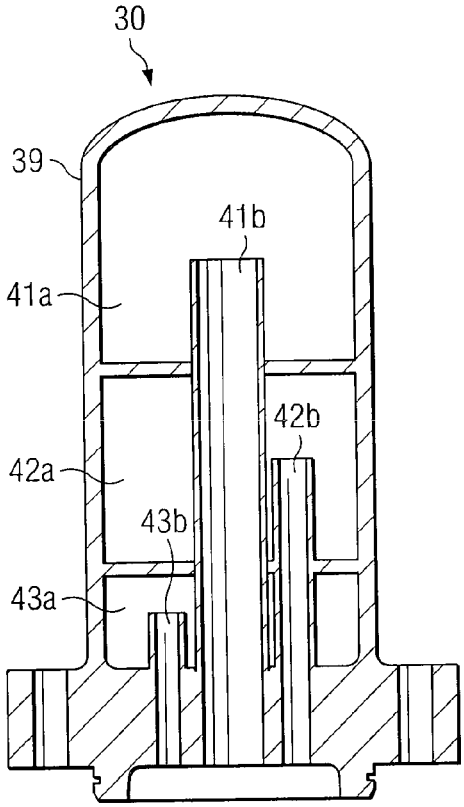
FIG. 4 is a cut-away view of the multi-chamber pulsation absorber.

A bottom plate 38 has three openings, each corresponding to an open end of an internal choke tube (see FIG. 4). These openings are in communication with gases expelled from or inducted into the associated compressor cylinder, via the valve port.

FIG. 4 is a cut-away view of the absorber 30. In the example of FIG. 4, absorber has three chambers 41*a*, 42*a*, and 43*a*, and three internal choke tubes 41*b*, 42*b*, and 43*b*. As illustrated, two partitions within the housing 39 divide the internal volume of the housing into the three chambers. The partitions are horizontal, such that the chambers are "stacked" vertically along the vertical axis of the housing 39.

The choke tubes are small sections of piping with two open ends. A choke tube is associated with (paired with) each chamber (volume), and each choke tube has a first end open to the compressor cylinder valve port and a second end open to the associated chamber. Each choke tube and chamber pairing is designed to dampen a different resonant frequency of the compressor system. In other embodiments, absorber 30 may have only two, or more than three, choke tubes and chamber pairings.

As is known in the art of side branch absorbers (also known as Helmholtz resonators) for other applications, the physical dimensions of each choke tube and its associated surge volume are not the same as their acoustic dimensions. The desired acoustic dimensions and the resulting physical dimensions are determined by various known calculation and acoustic modeling techniques. The internal volume of the chamber and the length and diameter of the choke tube are variables that can be used to "tune" the resonance of each choke tube and chamber pairing.

The acoustic dimensions of each choke tube and chamber pairing vary depending on the pulsation frequency to be dampened by that pairing. The resonant frequency to be damped may be determined by various measurement or predictive techniques. More specifically, the diameter and size of each choke tube and the size of its associated chamber determine an acoustic natural frequency. Each choke tube and chamber pairing is designed to dampen a different resonant frequency of the compressor system. At least one pairing is specifically designed to dampen cylinder internal (valve-to-valve) pulsations. Another is specifically designed to dampen nozzle pulsations. Additional choke tube and chamber pairings may be designed to dampen other internal cylinder pulsations.

In operation, two or more target frequencies to be damped are identified. Each choke tube and chamber pairing of the absorber is designed so that its acoustic response frequency matches that of the target frequency. Calculations for Helmholtz resonators may be used, and are well documented. Compressor system models may be used for further refinement of the absorber response. The absorber is then installed in place of or attached to the valve cap, such that each chamber, via its associated choke tube, is in fluid communication with the cylinder gas passage.

Figure 5:
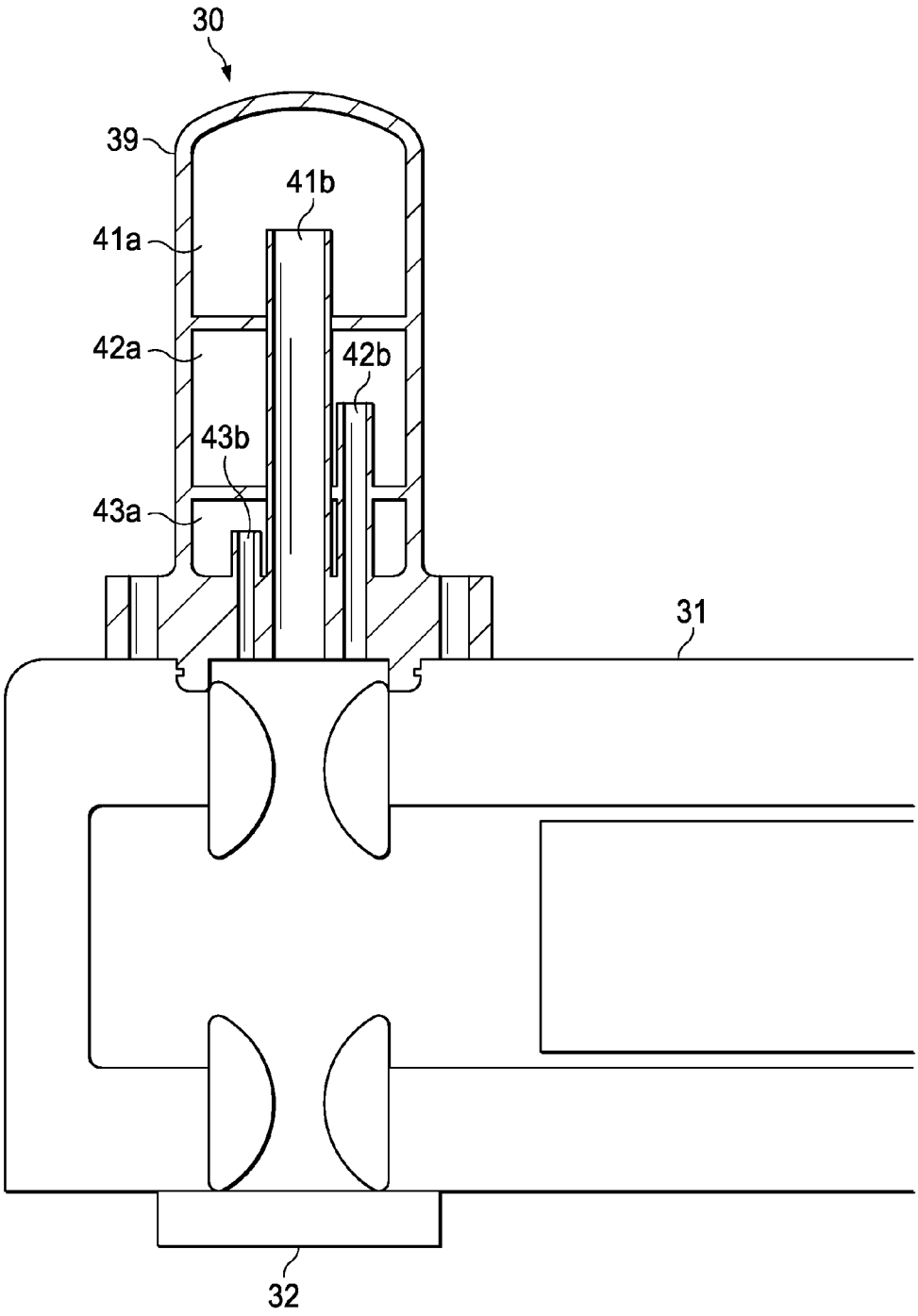
FIG. 5 illustrates the cutaway view of the absorber of FIG. 4, with the absorber installed in place of a valve cap, as in FIG. 2, so that it communicates with gas internal to the cylinder.

FIG. 5 illustrates the cutaway view of the absorber of FIG. 4, with the absorber installed in place of a valve cap, as in FIG. 2, so that it communicates with gas internal to the cylinder. As stated above, the absorber is installed such that each chamber, via its associated choke tube, is in fluid communication with the valve's internal gas passage. In other words, the openings at the bottom ends of the choke tubes are in communication with gases expelled from or inducted into the cylinder.

What is claimed is:

1. A method of reducing pulsations associated with a compressor system having one or more compressor cylinders, each cylinder having at least one valve cap, comprising:

determining the resonant frequency of internal cylinder pulsations;

determining the resonant frequency of cylinder nozzle pulsations;

installing a pulsation absorber in place of or on a cylinder valve cap;

wherein the pulsation absorber has at least the following elements: a housing having a bottom plate for installation in place of the valve cap or over a modified valve cap and a closed top end, the bottom plate having two or more openings; one or more partitions within the housing, operable to divide the internal volume of the housing into two or more chambers; a choke tube associated with each chamber, each choke tube having a first end open to a corresponding one of the openings in the bottom plate of the housing, and having a second end open to its associated chamber;

wherein the top end is dead-ended and all other surfaces of the housing are closed such that fluid enters and exits each chamber through that chamber's associated choke tube;

wherein each chamber has a single choke tube whose second end is open to that chamber;

wherein each opening and its corresponding choke tube is in fluid communication with gases expelled from or inducted into the cylinder; and wherein the absorber has the following dimensions optimized to reduce the peak pulsation amplitude of the resonant frequency of at least the internal cylinder pulsations and of the cylinder nozzle pulsations: surge volume of each chamber, length of each choke tube, and diameter of each choke tube such that each chamber and its associated choke tube has a different response to pulsations in the compressor system.

2. The method of claim 1, wherein the absorber is installed in place of or on a suction valve cap.

3. The method of claim 1, wherein the absorber is installed in place of or on a discharge valve cap.

4. A pulsation absorber for a compressor system having one or more cylinders, comprising:

a housing having a bottom plate for installation in place of a valve cap or over a modified valve cap and a closed top end, the bottom plate having two or more openings;

one or more partitions within the housing, operable to divide the internal volume of the housing into two or more chambers;

a choke tube associated with each chamber, each choke tube having a first end open to a a corresponding one of the openings in the bottom plate, and having a second end open to the associated chamber;

wherein the top end of the housing is dead-ended and all other surfaces of the housing are closed such that fluid enters and exits each chamber through that chamber's associated choke tube;

wherein each chamber has a single choke tube whose second end is open into that chamber;

wherein each opening and its corresponding choke tube is configured so that it is in fluid communication with gases expelled from or inducted into the cylinder via the valve;

wherein one or more of the following dimensions is designed to attenuate one or more target frequencies of the compressor system: volume of each chamber, length of each choke tube, and diameter of each choke tube such that each chamber and its associated choke tube has a different response to pulsations in the compressor system.

5. The absorber of claim 4, wherein the target frequency is the resonant frequency of internal cylinder pulsations.

6. The absorber of claim 4, wherein the target frequency is the resonant frequency of cylinder nozzle pulsations.

7. The absorber of claim 4, wherein the housing is generally cylindrical in shape.

8. The absorber of claim 4, wherein the housing has a longitudinal axis extending vertically from the valve cap, and wherein the partitions create horizontally stacked chambers.

* * * * *